US009085934B2

(12) United States Patent
Poundstone

(10) Patent No.: US 9,085,934 B2
(45) Date of Patent: Jul. 21, 2015

(54) REMOVABLE INTERIOR WINDOW TRIM SYSTEM AND METHOD

(71) Applicant: Seth D. Poundstone, Lakeville, MN (US)

(72) Inventor: Seth D. Poundstone, Lakeville, MN (US)

( * ) Notice: Subject to any disclaimer, the term of this patent is extended or adjusted under 35 U.S.C. 154(b) by 0 days.

(21) Appl. No.: 13/770,065

(22) Filed: Feb. 19, 2013

(65) Prior Publication Data

US 2014/0230350 A1 Aug. 21, 2014

(51) Int. Cl.

| | |
|---|---|
| ***E06B 3/964*** | (2006.01) |
| ***E06B 3/68*** | (2006.01) |
| ***E06B 1/34*** | (2006.01) |
| *E06B 1/36* | (2006.01) |

(52) U.S. Cl.
CPC . *E06B 3/685* (2013.01); *E06B 1/34* (2013.01); *E06B 1/36* (2013.01); *E06B 1/366* (2013.01)

(58) Field of Classification Search
CPC ..... E06B 1/18; E06B 3/32; E06B 3/30; E06B 3/303; E06B 3/305; E06B 3/306; E06B 3/307
USPC ..... 52/204.61, 204.5, 204.53, 204.54, 52/204.57, 204.62
See application file for complete search history.

(56) References Cited

U.S. PATENT DOCUMENTS

| | | | | |
|---|---|---|---|---|
| 7,082,727 | B2 * | 8/2006 | Schmidt | 52/204.71 |
| 2008/0245001 | A1 * | 10/2008 | Alkoury et al. | 52/204.5 |
| 2012/0240492 | A1 * | 9/2012 | Woodward et al. | 52/204.5 |

* cited by examiner

*Primary Examiner* — Mark Wendell
(74) *Attorney, Agent, or Firm* — Dakota Law P.L.L.C; Gary L. Huusko

(57) ABSTRACT

A removable interior window trim system and method is comprised of either cut to size trim pieces or a pre-fabricated trim unit sized to insert within the jambs of a window and secure to the jamb and/or window frame and cover any existing mullions. The trim system can be secured in many ways, such as trim nails, adhesives, or spring loaded stops. The resulting trim system is particularly useful in creating a more expensive looking window during the course of window installation, but can also be used to retroactively improve the look of existing windows while allowing the user to change systems to create different looks without installing a new window.

7 Claims, 2 Drawing Sheets

REMOVABLE INTERIOR WINDOW TRIM SYSTEM AND METHOD

BACKGROUND OF THE INVENTION

1. Field of the Invention

Figure 1:
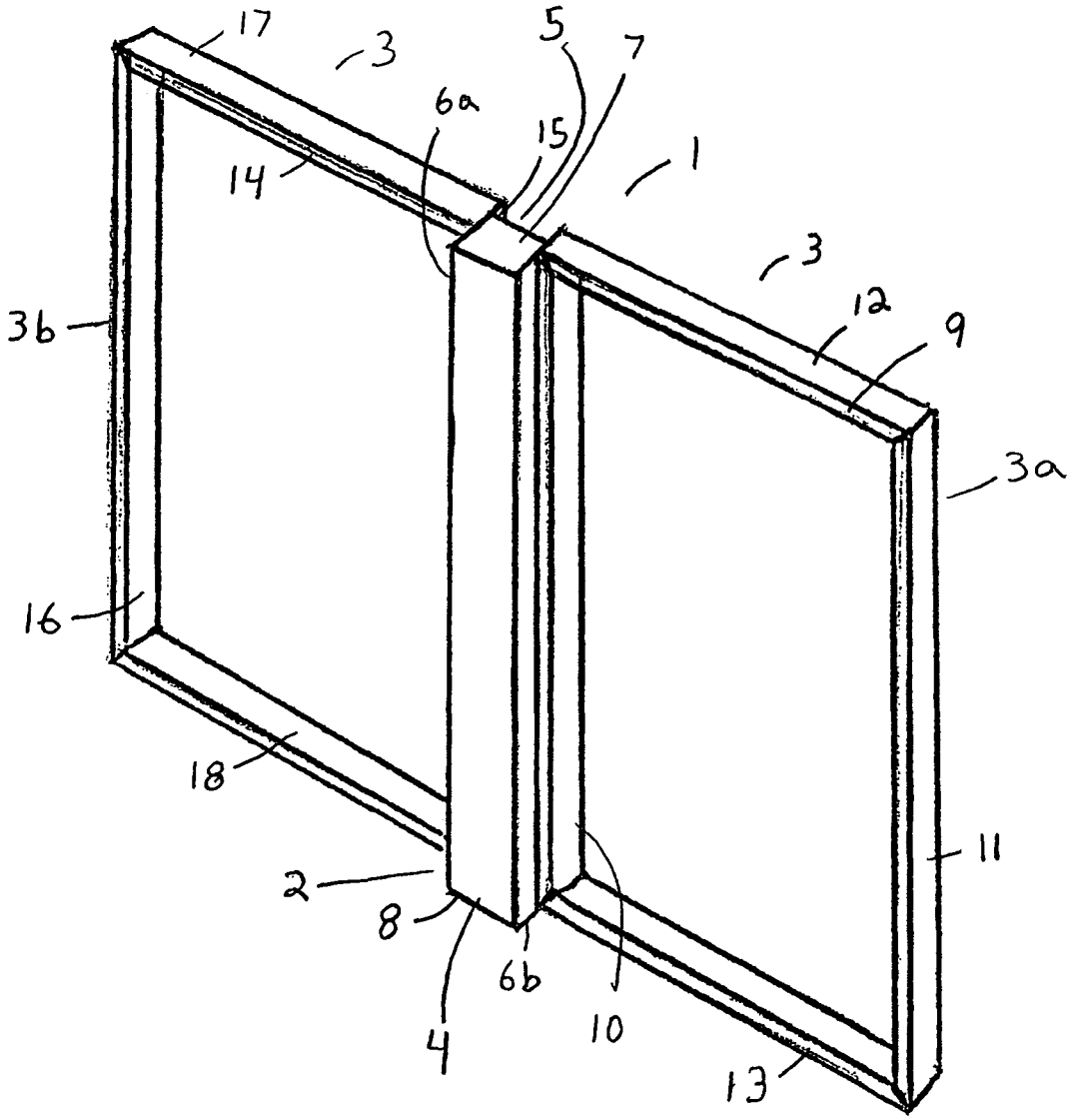

This invention relates to windows and doors, trim assemblies for windows and doors, and the related processes for trimming a window or door.

2. Description of Related Art

During the course of new building construction or during building renovations, remodeling and other activities which involve the installation or replacement of a window, it is desirable to install energy efficient, cost effective, and attractive windows. Typically products available for purchase have one or two of these qualities, due to the limiting factors of manufacturing. For example, a high quality window with wood trimmed interior and excellent energy efficiency would be considerably more expensive than a fiberglass window with excellent energy efficiency and a less attractive, non-wood trimmed interior. It is desirable to have the cost savings and strength of fiberglass or vinyl in the construction of the window, yet desirable to have wood trimmed interior for a high quality look inside the building. It is now common to use solid wood jambs and casing trim when installing a window, regardless of the actual window material. This is done because consumers desire the quality look of wood even if they do not purchase windows with wood interior trim. The current invention solves the above problem by providing a removable and easily insertable interior window trim system that installs within the window jambs and abuts the window frame. The result is a new appearance for the window, which gives the home owner the ability to purchase less expensive yet energy efficient windows and improve the appearance of the interior of the window after the initial purchase, or change appearance periodically as the tastes of the home owner change.

SUMMARY OF THE INVENTION

This invention comprises a removable interior trim system which converts the appearance of the interior of a window. The system obscures the inside view of standard window components such as the frame and mullions, thereby creating a new appearance. The trim system can be constructed from wood and finished to match the jambs and casing of the window, or may be constructed from plastics or other composite materials and finished according to the desires of the home owner.

The trim system is built specifically for the dimensions of each window. A simple measurement system is used to determine the manufacturing specifications for each trim system. Measurements of the existing window from jamb to jamb, jamb to mullion, and mullion width and height are needed. Once measured, sizes and measurements for frame trim and mullion covers are determined. The trim system can then be assembled or molded to fit within the jambs, and abut the window frame. To secure the trim system, any manner of attaching means can be used, such as trim nails, screws, adhesives, spring loaded stops, or any other such method for securing the trim system to either the jambs or directly to the window frame itself. Once installed, the window will continue to operate or not operate as specified with its original manufactured intentions. The trim system thus covers the interior frame or frames and any mullions so as to create the desired appearance of the home owner. Should the home owner desire a new appearance for their windows after installing this system, they can easily remove the trim system by reversing the method of installation used, and then modifying the appearance of the trim system or purchasing a new one, and then reinstall the new trim system. In any of the cases described, the purchase of a new window is not needed to change the appearance of the window. In addition to retrofitting this system or purchasing to specification, a window manufacturer could produce this system in conjunction with a window assembly where the two have aligning joints, slots, or otherwise means of attaching so as to have a factory produced version of this removable system. The benefit of this would be a much simpler baseline manufacturing system, with windows produced with flat plain surfaces on the interior. The manufacturer could then simply produce or outsource production of the interior trim system to meet the desires of the customer for each order.

DETAILED DESCRIPTION OF DRAWINGS

Referring to FIG. 1, the removable trim system 1 comprises a generally rectangular shape to fit within the jambs of a window. Each trim system has at least one frame cover 3. The preferred embodiment would have at least one mullion 2 and at least two frame covers 3, typically a right frame cover 3*a* and a left frame cover 3*b*. Each trim system could have as many frame covers 3 as the window has sashes, and as many mullion covers 2 as the window has mullions. For the purposes of this description, let us use a two wide window with two sashes and one centered mullion. The mullion cover 2 is rectangular in shape with a front surface 4, a back portion 5, two sides 6*a* and 6*b*, a top edge 7 and a bottom edge 8. The right frame cover 3*a* comprises a right frame inside surface 9, a right mullion side frame piece 10, a right outside frame piece 11, a right top frame piece 12 and a right bottom frame piece 13. The right mullion side frame piece 10, right outside frame piece 11, right top frame piece 12 and right bottom frame piece 13 are assembled together in a rectangular configuration and the right mullion side frame piece 10 of the right frame cover 3*a* is fixedly attached to one of the sides of the mullion cover 2 wherein the inside of the right frame surface 9 is facing into the room where the existing window is located. The left frame cover 3*b* comprises a left frame inside surface 14, a left mullion side frame piece 15, a left outside frame piece 16, a left top frame piece 17 and a left bottom frame piece 18. The left mullion side frame piece 15, left outside frame piece 16, left top frame piece 17 and left bottom frame piece 18 are assembled together in a rectangular configuration and the left mullion side frame piece 15 of the left frame cover is fixedly attached to the other side of the mullion cover 2, opposite the right mullion side frame piece 10, wherein the inside of the left frame surface 14 is facing into the room where the existing window is situated.

Figure 2:
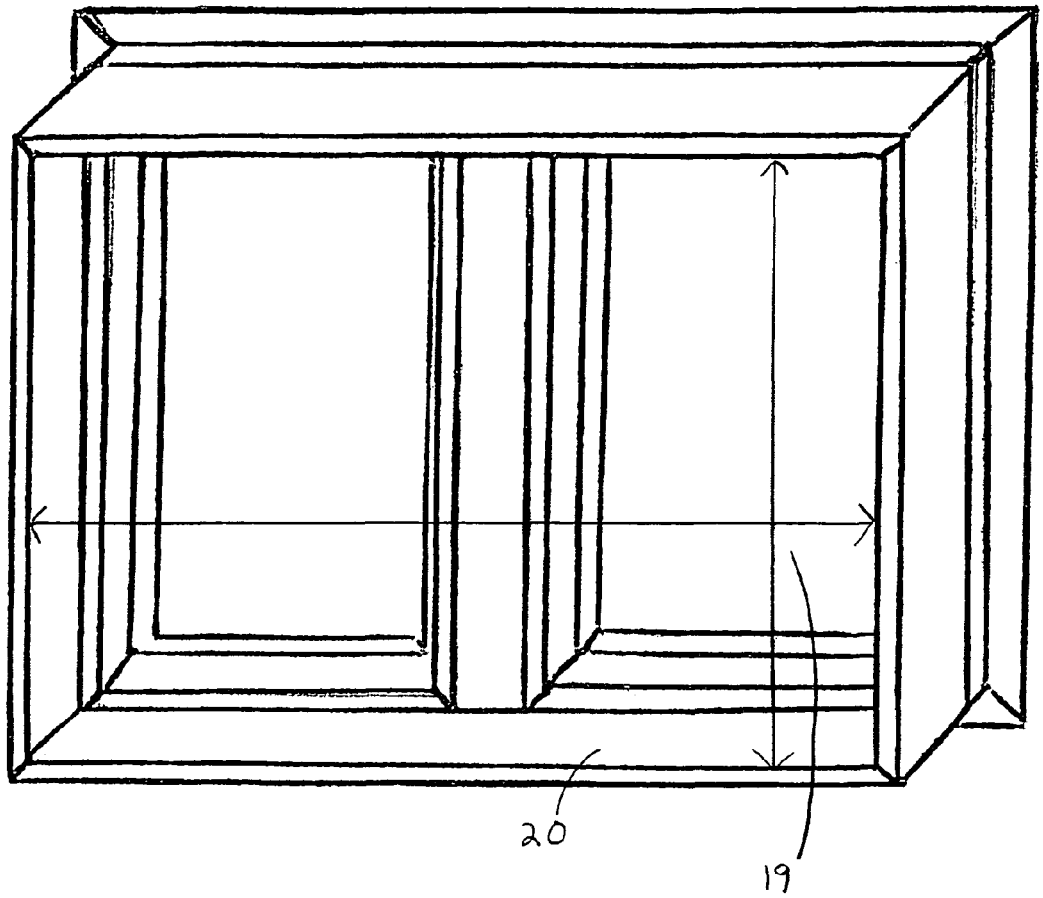

Referring now to FIG. 2, the trim system is manufactured to specifications for a variety of manufactured windows, such as shown in FIG. 2, and can be specially manufactured for most windows. The trim system has an outer dimension that is very slightly smaller than the inner dimension 19 of the window jambs 20 within which it will be slid. The trim system, in operation, slides inside the window jambs of an existing window, thus allowing the trim system to fit relatively tightly against the window jambs while still allowing the trim system to be removed without causing damage to the window frame or window jambs, thus providing a decorative feature to the existing window when viewed from inside. To attach the trim system to the window jambs, nails, screws, staples, or other fastening devices, or the like, can be used. To attach to the window frame directly, adhesives, grooves, slots, or any other means could be used on order to temporarily yet securely attach the trim to the frame of the window directly.

The trim system can be made out of natural or manmade materials, such as wood, wood products, plastic, fiberglass or the like, although any type of rigid material can be used. The trim system further comprises an inside surface with a wood-like, textured, painted, stained or decorated surface to provide a decorative feature to a room window after installation of the trim system.

The frame cover or covers, and mullion cover or covers can vary in thinness and width, and its thickness and width are limited only by the existing window frame and mullion dimensions and the desires of the home owner. The trim system can be specially manufactured with grooves and cut-outs along any of its edges to accommodate window hardware and other mechanisms existing in or on the window or its frame.

I claim:

1. A removable interior window trim system to change or improve the visual features of a room within which the window is located and the window when viewed from inside a room, the removable interior window trim system comprising, a window and a window jamb, the window comprising an interior window portion viewable from the inside of the room, the window jamb comprising an interior window jamb portion viewable from the inside of the room, a removable interior frame cover, the removable interior frame cover comprising an inside surface, a right side frame piece, a left side frame piece, a top frame piece, a bottom frame piece, and an outer dimension, the right side frame piece, left side frame piece, top frame piece, and bottom frame piece are assembled and fixedly attached together to form a rectangular shape defining the outer dimension, the outer dimension of the removable interior frame cover fitting within the existing interior window portion and interior window jambs portion or new window, the removable interior frame cover being removably insertable into the existing interior window portion and interior window jamb portion or new window covering the existing interior window portion and interior window jamb portion or new window, the inside surface of the removable interior frame cover being viewable from the inside of the room, whereby the visual feature of the room within which the window is located and the visual feature of the interior portion of the window when viewed from inside of the room is changeable or improved by inserting the removable interior frame cover into the existing interior window frame portion and within the existing interior window jamb portion.

2. The trim system of claim 1 wherein the frame inside surface has a decorative feature viewable from inside of the room.

3. The trim system of claim 1 wherein the removable interior frame cover further comprises one or more window hardware mechanism cut-outs.

4. The removable interior window trim system of claim 1 further comprising, at least one mullion cover, and a plurality of removable interior frame covers, the mullion cover comprising a rectangular shape with a front surface, a back portion, two sides, a top edge and a bottom edge, each removable interior frame cover further comprising a frame inside surface, a mullion side frame piece, an outside frame piece, a top frame piece and a bottom frame piece, the mullion side frame piece, outside frame piece, top frame piece and bottom frame piece of each removable interior frame cover are assembled and fixedly attached together to form a rectangular shape and the mullion side frame piece of each removable interior frame cover is fixedly attached to one side of the mullion cover, wherein the removable interior frame cover is inserted into the existing interior window portion, fitting within the interior window jamb with the mullion cover or covers fitting over the existing window mullion or mullions, whereby the visual feature of the room within which the window is located and the visual feature of the interior portion of the window when viewed from inside of the room can be changed or improved by inserting the removable interior frame cover into the existing interior window frame portion and within the existing interior window jambs portion.

5. The trim system of claim 4 further comprising a plurality of mullions and where at least one removable interior frame cover is an inside frame cover where the outside frame piece is a mullion side frame piece.

6. The trim system of claim 4 wherein each mullion cover front surface and frame inside surface have a decorative feature viewable from inside of the room.

7. The trim system of claim 4 wherein each removable interior frame cover further comprises one or more window hardware mechanism cut-outs.

* * * * *